US005105527A

United States Patent [19]

Miyata

[11] Patent Number: 5,105,527

[45] Date of Patent: Apr. 21, 1992

[54] METHOD OF AND APPARATUS FOR PROCESSING WIRES FASTENING COMPRESSED WASTEPAPER BLOCK

[75] Inventor: Toshiro Miyata, Aichi, Japan

[73] Assignee: Kondo Unyu-Kiko Co., Ltd., Aichi, Japan

[21] Appl. No.: 585,046

[22] Filed: Sep. 20, 1990

Related U.S. Application Data

[63] Continuation of Ser. No. 346,739, May 3, 1989, abandoned.

[51] Int. Cl.[5] ..... B65B 69/00

[52] U.S. Cl. ..... 29/564.3; 83/176; 83/909

[58] Field of Search ..... 29/426.4, 564.3; 83/176, 909; 414/412

[56] References Cited

U.S. PATENT DOCUMENTS 3,513,522 5/1970 Thomson ..... 83/909 X

FOREIGN PATENT DOCUMENTS

| | | | |
|---|---|---|---|
| 0240289 | 7/1987 | European Pat. Off. . | |
| 64-9137 | 1/1989 | Japan | 414/412 |
| 64-37335 | 2/1989 | Japan | 414/412 |
| 2076355 | 12/1981 | United Kingdom . | |
| 2184704 | 7/1987 | United Kingdom | 414/412 |

OTHER PUBLICATIONS

European Search Report completed Dec. 12, 1989 by Examiner Claeys H. C. M. at the Hague.

*Primary Examiner*—Joseph M. Gorski
*Attorney, Agent, or Firm*—Staas & Halsey

[57] ABSTRACT

A compressed wastepaper block fastened by a plurality of wires is placed on a working table, and deformed or bent arcuately on the working table. After the compressed wastepaper block is bent, wires exposed in a concave created by the bent compressed wastepaper block are gripped by a presser/wire clamp, and a cutter is thrust substantially centrally into a convex side of the compressed wastepaper block which is opposite to the concave, thereby to cut off the exposed wires. The wires thus cut off are then removed from the compressed wastepaper block.

6 Claims, 6 Drawing Sheets

METHOD OF AND APPARATUS FOR PROCESSING WIRES FASTENING COMPRESSED WASTEPAPER BLOCK

This is a continuation of copending application Ser. No. 07/346,739 filed on May 3, 1989 and now abandoned.

BACKGROUND OF THE INVENTION

The present invention relates to a method of and an apparatus for efficiently processing wires which fasten a compressed wastepaper block.

Wastepaper such as of newspapers, magazines, or the like, which are collected by a wastepaper collector is compressed by a compressor into a rectangular block, which is then fastened by a plurality of wires and sent to a paper regenerating factory. In the paper regenerating factory, the compressed wastepaper block is loosened by a loosening machine. Prior to the loosening of the compressed wastepaper block, however, the fastening wires must be removed from the compressed wastepaper block.

Heretofore, it has been customary to remove the wires manually. That is, the wires have been cut off, one by one, by a cutter operated by the operator. However, it has been time-consuming to cut off the wires since the wires are deeply embedded in the compressed wastepaper block. The manual process also has had a safety problem since the operator tends to get injured when cutting off the wires.

To solve the above problems, there has been proposed an automatic wire cutting apparatus as disclosed in Japanese Patent Publication No. 62-26976.

The disclosed automatic wire cutting apparatus comprises a tooth plate having an array of teeth with pointed ends, another tooth plate having teeth held in intimate contact with the first tooth plate and reciprocally movable longitudinally of the first tooth plate, and a presser mechanism for pressing the tooth plates to force the tooth ends into a compressed wastepaper block for cutting off the wires around the wastepaper block. After the pointed tooth ends have been forced into the wastepaper block, the teeth of the two plates are displaced in sliding engagement with each other to cut off the wires.

With the conventional automatic wire cutting apparatus, the tooth plates have to be forced into the wastepaper block before the wires are cut off or processed. Inasmuch as the wires are embedded in the wastepaper block at a considerably large depth, a substantial force must be applied to the tooth plate in order to push the tooth ends deeply into the wastepaper block. Sometimes, the wires may not be cut off because the tooth ends are not driven deeply enough to reach the wires. When cutting off the wires, the wastepaper is also cut off, producing a large quantity of paper dust which makes the working environment bad.

SUMMARY OF THE INVENTION

It is a major object of the present invention to provide a method of and apparatus for safely and easily processing, i.e., cutting off, wires which fasten a rectangular compressed wastepaper block that has been produced from wastepaper such as of newspapers, magazines, or the like, by a compressor.

Another object of the present invention is to provide a method of and an apparatus for processing. i.e., cutting off, wires which fasten a compressed wastepaper block, by bending the compressed wastepaper block arcuately to tension wire portions on a projecting side of the block in order to expose the wires partly on a surface of the block for allowing a cutter to cut off the wires smoothly, and also to simply process the wires that have been cut off.

To accomplish the above objects, there is provided according to the present invention a method of processing a wire fastening a compressed block of paper material, comprising the steps of: deforming the compressed block substantially arcuately; gripping a portion of the wire which is exposed in a concave created by the deformed compressed block, with a presser/wire clamp; thereafter driving a cutter through a portion of the wire which is disposed over a convex side of the deformed compressed block which is opposite to the concave, to cut off the wire; and removing the wire that has been cut off from the compressed block.

According to the present invention, there is also provided an apparatus for processing a wire fastening a compressed block of paper material, comprising: bending means for bending the compressed block on a working table substantially arcuately; gripping means for gripping portions of the wires which are exposed in a concave created by the bent compressed block; cutting means for cutting off a portion of the wire which is disposed over a convex side of the bent compressed block which is opposite to the concave; feeding means for delivering out the wires cut off by the cutting means; and severing means for severing the wire delivered by the feeding means. The bending means comprises a presser/ wire clamp disposed on one side of the working table for pressing the compressed block, and a bending guide plate for guiding the compressed block, the bending guide plate being disposed on an opposite side of the working table in confronting relation to the presser/wire clamp. The gripping means comprises a rack disposed in the bending means and a pair of fingers movable by the rack through a pinion and a gear coupled respectively to the fingers, for gripping and releasing the wire. The wire can be gripped reliably by the fingers. The cutting means comprises a cutter movable toward and away from the compressed block by a hydraulic cylinder. The feeding means comprises a fixed feed roller and a movable feed roller movable into coaction with the fixed feed roller. The severing means comprises a fixed cutter blade and a movable cutter blade movable into coaction with the fixed cutter blade by a hydraulic cylinder.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
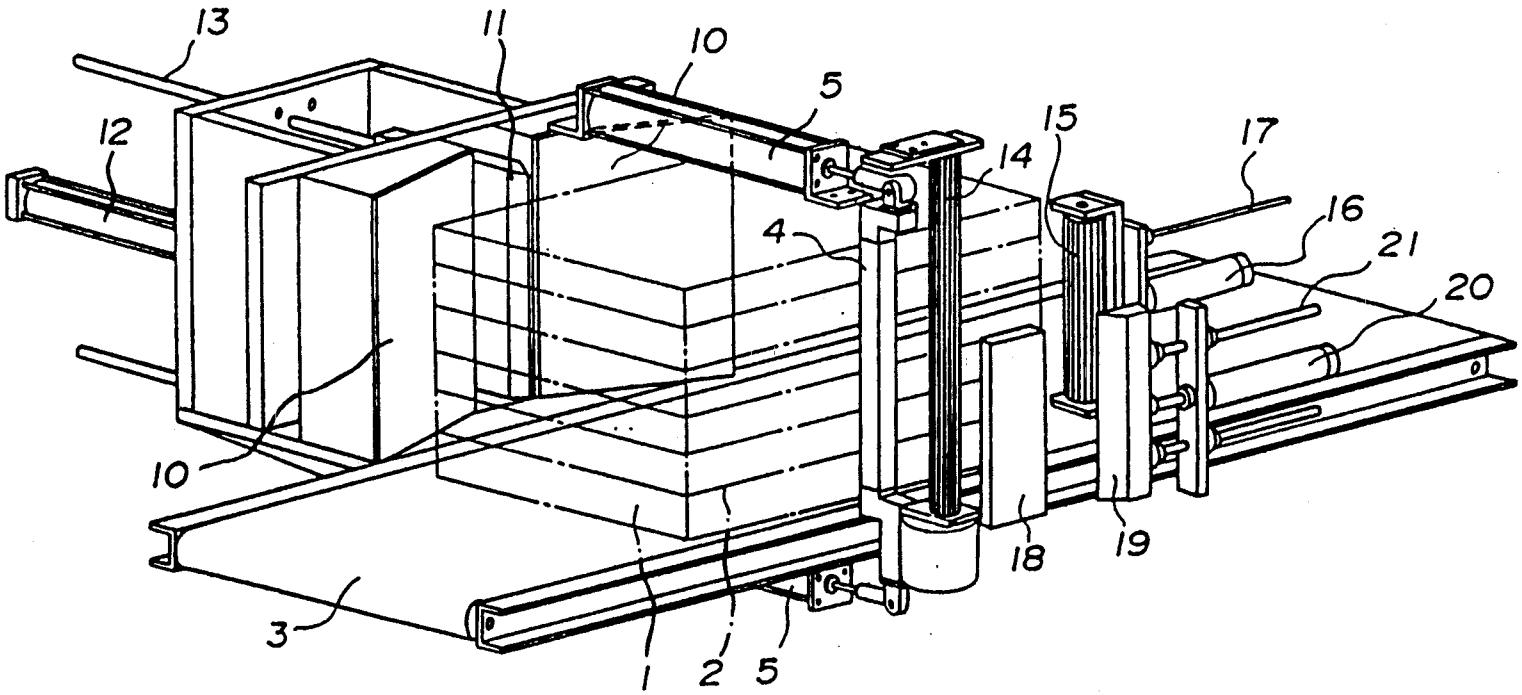
FIG. 1 is a perspective view of a fastening wire processing apparatus according to the present invention.

FIG. 1 shows an apparatus for processing wires which fasten a compressed wastepaper block 1 that is in the form of a stack of sheets of wastepaper such as newspapers, magazines, or the like, the compressed wastepaper block 1 being tightly fastened by a plurality of wires 2 looped around the block 1. The wire processing apparatus includes a working table 3 comprising a slat conveyor, or the like, for placing the compressed wastepaper block 1, a presser/wire clamp 4 disposed on one side of the working table 3 where the compressed wastepaper block 1 is to be bent, and a pair of hydraulic cylinders 5 connected, respectively, to the upper and lower ends of the presser/wire clamp 4. When the piston rods of the hydraulic cylinders 5 are extended, the presser/wire clamp 4 is retracted away from the working table 3. When the piston rods are contracted, the presser/wire clamp 4 is moved toward the working table 3. While the hydraulic cylinders 5 are shown as being attached to the upper and lower ends, respectively, of the presser/wire clamp 4 in the illustrated embodiment, only one hydraulic cylinder may be coupled to a substantially central portion of the back surface of the presser/wire clamp 4 for moving the presser/wire clamp 4 back and forth. The single hydraulic cylinder is advantageous in that it is not necessary to employ a control sequence which would otherwise operate the two hydraulic cylinders in timed relation, the amount of oil used is reduced, and the speed of operation is increased.

Figure 2:
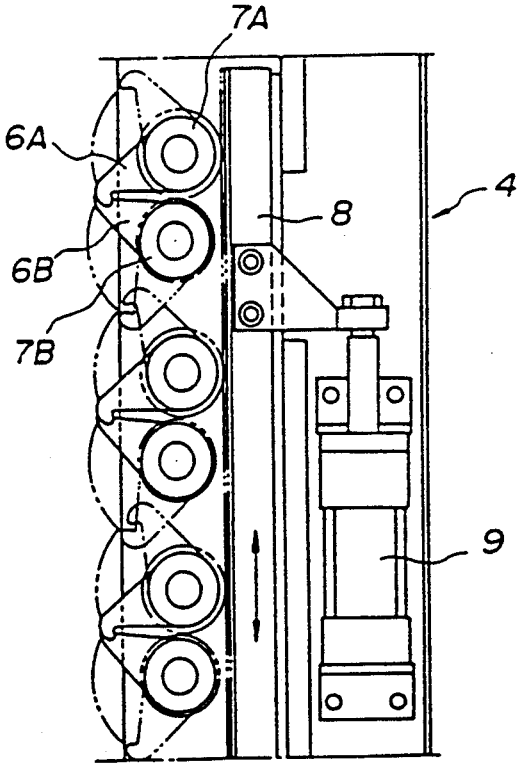
FIG. 2 is an elevational view of a presser/wire clamp.
Figure 3:
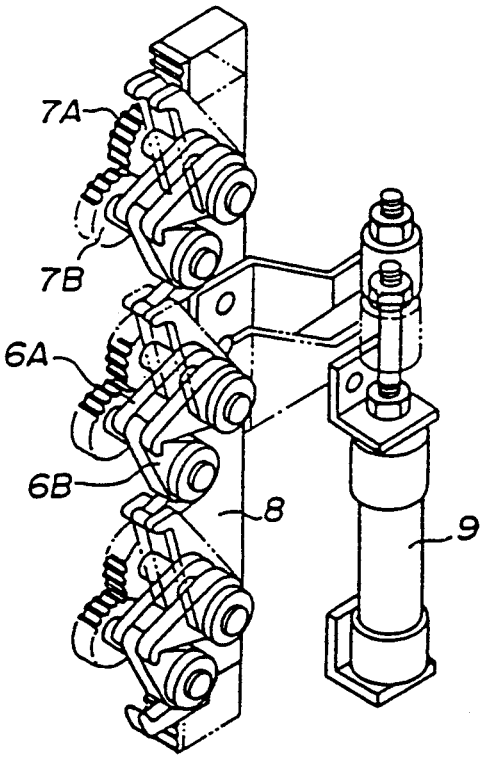
FIG. 3 is a perspective view of the presser/wire clamp.

As shown in FIGS. 2 and 3, the presser/wire clamp 4 has a plurality of pairs of fingers 6A, 6B for gripping or clamping the wires 2. The fingers 6A are mounted, respectively, on the shafts of pinions 7A, whereas the fingers 6B are mounted respectively on the shafts of gears 7B meshing with the corresponding pinions 7A. The presser/wire clamp 4 also includes a rack 8 meshing with the pinions 7*a* and connected to a hydraulic clamp cylinder 9 in the presser/wire clamp 4. When the rack 8 is elevated by the clamp cylinder 9, the pinions 7A and the gears 7B are rotated about their own axes to close the pairs of fingers 6A, 6B to clamp the wires 2 which are exposed on a concave side of the compressed wastepaper block 1, as described later on. When the piston rod of the clamp cylinder 9 is contracted, the rack 8 is lowered to rotate the pinions 7A and the gears 7B in the opposite directions to open the fingers 6A, 6B. When the fingers 6A, 6B are opened to the maximum angular extent, the fingers 6A, 6B are concealed in a casing of the presser/wire clamp 4.

In FIG. 1, the wire processing apparatus also includes a pair of erected bending guide plates 10 having respective tapered surfaces and disposed in confronting relation to the presser 4 across the working table 3. While the bending guide plates 10 are shown as being centrally separated from each other in the illustrated embodiment, they may be joined to each other at upper and lower portions thereof, with a central vertical slot left therebetween for entering a cutter (described later) therethrough. The apparatus further includes a cutter 11 disposed, as a means for cutting off wires, substantially centrally between the guide plates 10, a hydraulic cylinder 12 for moving the cutter 11 back and forth, and horizontal guide posts 13 for allowing the cutter 11 to move stably back and forth.

A fixed feed roller 14 is positioned near the presser/wire clamp 4 for processing the wires 2 that have been cut off. A movable feed roller 15 coacts with the fixed feed roller 14. The feed rollers 14, 15 have longitudinal teeth on their circumferential surfaces which can mesh with each other for processing the wires 2, as described later on.

The movable feed roller 15 can be moved by a hydraulic cylinder 16. The movable feed roller 15 is guided for stable movement by horizontal guide posts 17. When the hydraulic cylinder 16 is extended, the movable feed roller 15 is moved up to the fixed feed roller 14 until their teeth mesh with each other for clamping the wires 2 to deliver out the wires 2. A motor is disposed below the fixed feed roller 14 and has its output shaft coupled to the lower end of the fixed feed roller 14 for rotating the feed roller 14 about its own axis.

The feed rollers 14, 15 are vertically elongate and disposed in horizontally confronting relation to each other. However, relatively short feed rollers may be disposed in vertically confronting relation to each other.

A fixed cutter blade 18 is securely positioned near the feed rollers 14, 15. A movable cutter blade 19 is movably located near the fixed cutter blade 18, the movable cutter blade 19 being movable toward and away from the fixed cutter blade 18 by means of a hydraulic cylinder 20 while being guided by guide posts 21.

In the embodiment shown in FIG. 1, the guide plates 10 are fixed and have tapered surfaces. However, actuators such as hydraulic cylinders may be disposed behind and coupled to these guide plates for tilting opposite wings of the guide plates toward the working table 3. Alternatively, a pair of hydraulic cylinders may be connected to the back surfaces of the guide plates 10 to move the guide plates 10 back and forth, so that the guide plates 10 can be moved toward the presser/wire clamp 4 by the hydraulic cylinders to reduce the distance to be traversed by the presser/wire clamp 4.

The presser/wire clamp 4 and the guide plates 10 confronting the presser/wire clamp 4 jointly serve as a bending means for bending the compressed wastepaper block 1. The rack 8 and the fingers 6A, 6B jointly constitute a clamping means for clamping the wires 2. As described above, the cutter 11 actuatable by the hydraulic cylinder 12 serves as the cutting means for cutting off the wires 2. The fixed feed roller 14 and the movable feed roller 15 jointly serve as a feeding means for feeding the wires 2. The fixed cutter blade 18 and the movable cutter blade 19 jointly serve as a severing means for severing the wires 2 that have been cut off by the cutter 11 and delivered by the feeding means.

A method of processing or cutting off the wires 2 fastening the compressed wastepaper block 1 will be described below.

Figure 4:
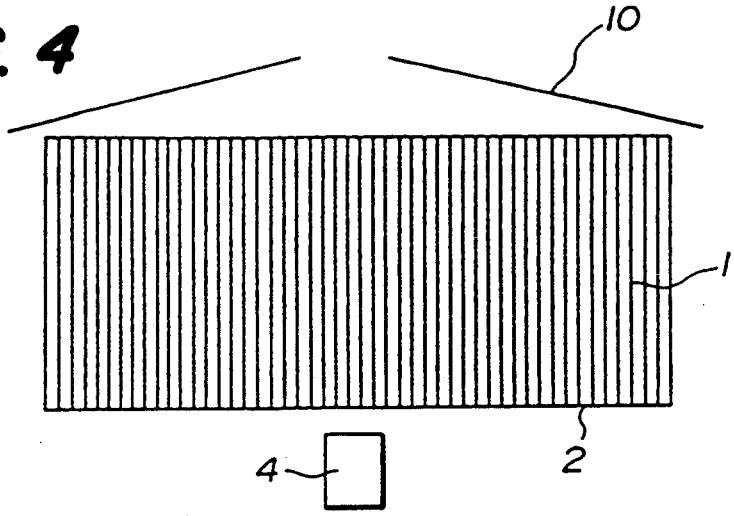
FIGS. 4 and 5 are schematic views showing the step of bending a compressed wastepaper block.
Figure 5:
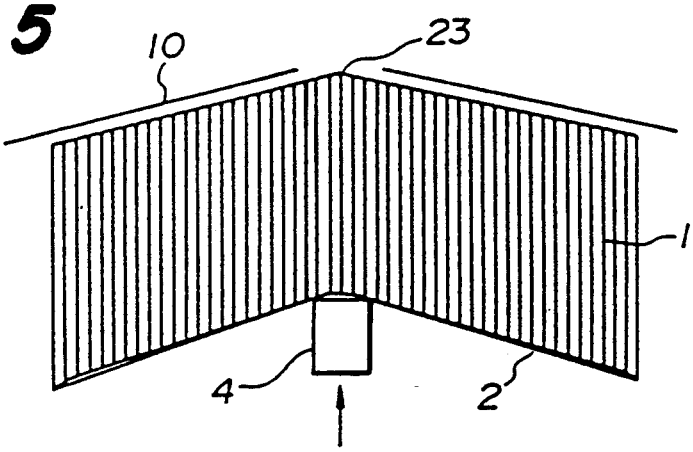

The compressed wastepaper block 1 is placed on the working table 3 such that the direction in which the paper layers of the compressed wastepaper block 1 are stacked extends transversely across the working table 3. When the compressed wastepaper block 1 is moved toward a predetermined bending position by the conveyor of the working table 3, it is detected by a limit switch (not shown) and stopped in the bending position (see FIG. 4). Then, the hydraulic cylinder 5 is operated to move the presser/wire clamp 4 in the direction indicated by the arrow in FIG. 5. The distal end of the presser/wire clamp 4 is then brought into contact with a substantially central area of one side of the compressed wastepaper block 1. Continued movement of the presser/wire clamp 4 causes the opposite side of the compressed wastepaper block 1 to engage the guide plates 10. The compressed wastepaper block 1 is now forcibly bent arcuately by being guided by the tapered surfaces of the guide plates 10 (see FIG. 5).

Figure 6:
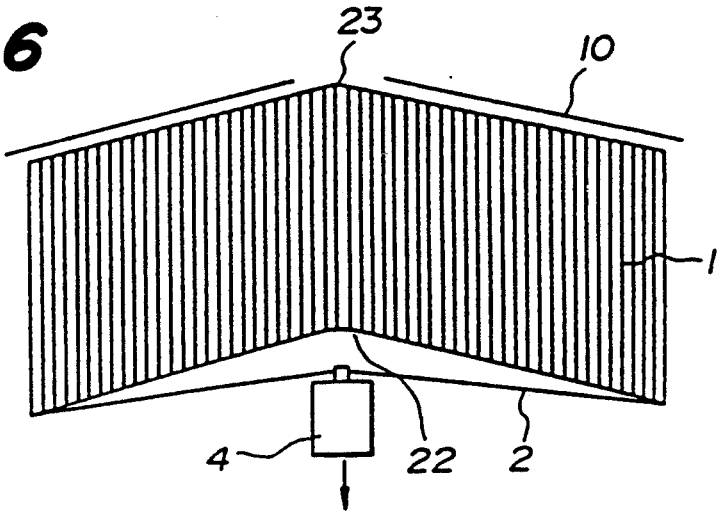
FIGS. 6 and 7 are schematic views showing the manner in which a wire exposed on a concave side of the bent compressed wastepaper block is gripped by the presser/wire clamp.

When the compressed wastepaper block 1 is thus bent, the wires 2 which have been embedded in the compressed wastepaper block 1 are brought out and exposed on a concave 22 created by the compressed wastepaper block 1 (FIG. 6). Since the presser/wire clamp 4 is positioned substantially centrally in the concave 22, the tensioned wires 2 which have been exposed are held against the distal end of the presser/wire clamp 4.

Then, the presser/wire clamp 4 is retracted away from the compressed wastepaper block 1 as shown in FIG. 6. The tensioned wires 2 are also separated fully from the compressed wastepaper block 1. At this time, the clamp cylinder 9 of the presser/wire clamp 4 is operated to enable the pairs of clamps 6A, 6B to grip or clamp the wires 2 (FIG. 6).

Figure 7:
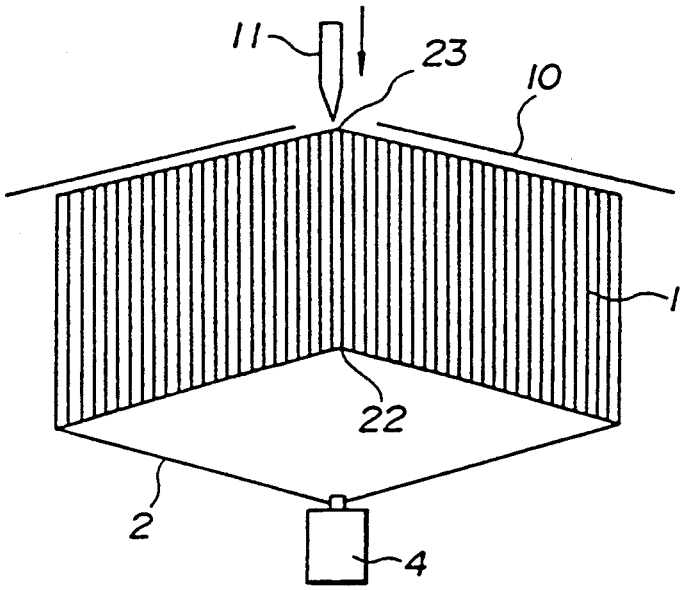

After it has been confirmed that the wires 2 are fully clamped by the presser/wire clamp 4, the presser/wire clamp 4 is further retracted away from the compressed wastepaper block 1 to tension the portions of the wires 2 which are positioned on a convex or projecting side 23 of the compressed wastepaper block 1 near the guide plates 10 (see FIG. 7). Because the compressed wastepaper block 1 is considerably heavy and the direction in which the sheet layers thereof extends transversely across the working table 3, the bent compressed wastepaper block 1 will not return to its original shape even when the compressed wastepaper block 1 is released of the pressure from the presser/wire clamp 4.

Figure 8:
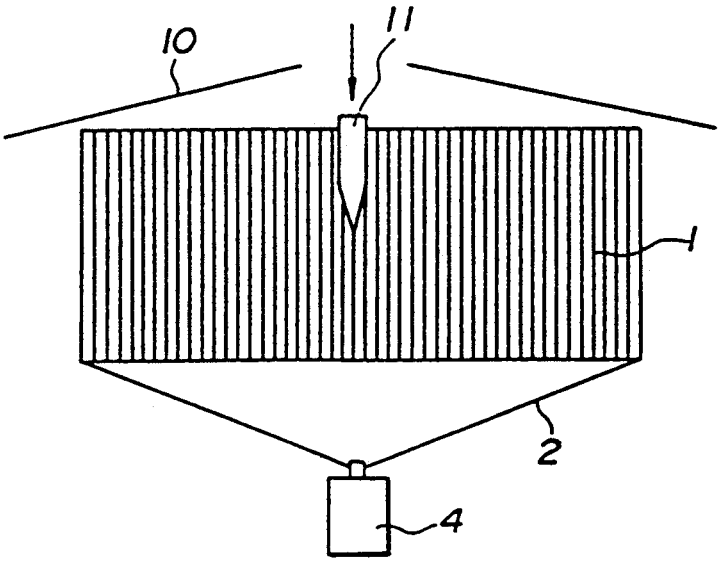
FIGS. 8 and 9 are schematic views illustrating the manner in which a wire on a projecting side of the compressed wastepaper block is cut off.

Then, the hydraulic cylinder 12 is actuated to thrust the cutter 11 substantially centrally into the projecting side 23 of the compressed wastepaper block 1 (FIG. 8). More specifically, the presser/wire clamp 4 which grips the wires 2 is retracted and then stopped in the position of FIG. 7 as electrically detected by a sensor (not shown), after which the hydraulic cylinder 12 is operated to drive the cutter 11 substantially centrally into the convex side of the compressed wastepaper block 1. At this time, the wires 2 are reliably severed by the cutter 11 since the wires 2 on the convex side 23 are held under considerable tension.

The thrusting movement of the cutter 11 into the convex side 23 of the compressed wastepaper block 1 pushes the convex side 23 back toward the concave 22, so that the bent compressed wastepaper block 1 may return to its original shape (see FIG. 8).

Figure 9:
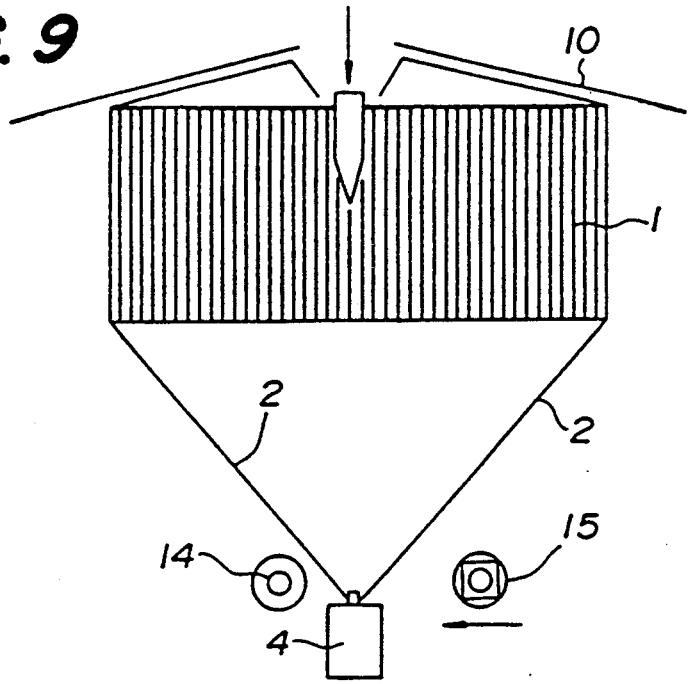

After the cutting off of the wires 2 is confirmed, the piston rod of the hydraulic cylinder 12 is retracted, and the presser/wire clamp 4 is retracted to a position behind the feed rollers 14, 15 for withdrawing the wires 2 from the compressed wastepaper block 1 (FIG. 9).

Figure 10:
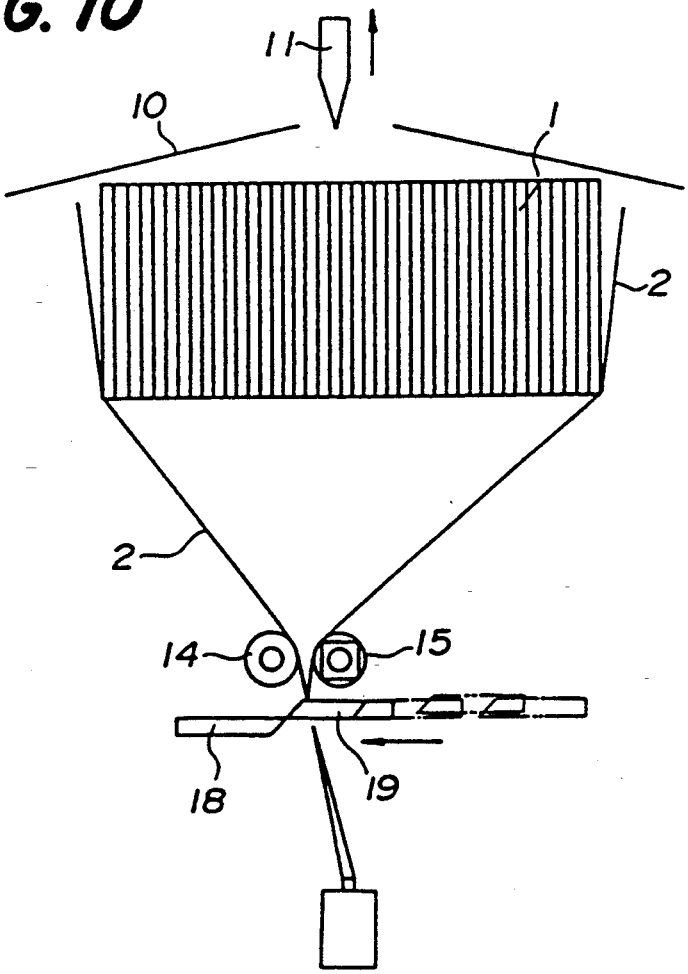
FIGS. 10 and 11 are schematic views showing the manner in which the wire that has been cut off is processed.
Figure 11:
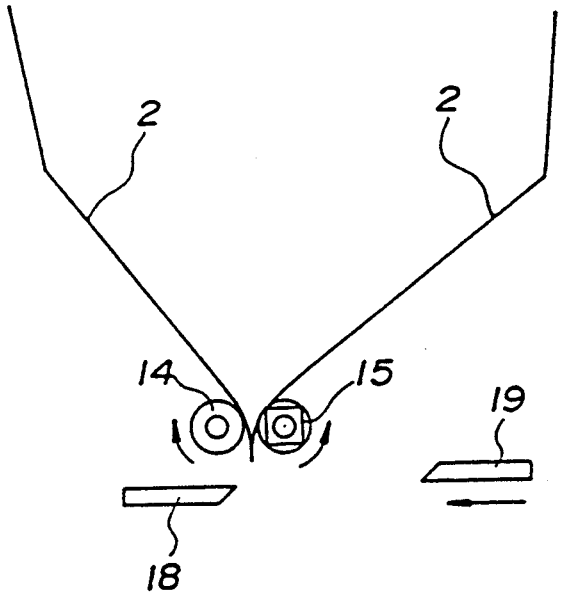

Then, the movable feed roller 15 is moved toward the fixed feed roller 14 by the hydraulic cylinder 16 until their teeth mesh with each other with the wires 2 interposed therebetween. The movable cutter blade 19 is moved toward the fixed cutter blade 18 by the hydraulic cylinder 20 to cut off the wires 2 (FIG. 10). The feed rollers 14, 15 are then rotated to deliver out the wires 2 by a predetermined length, and then the cutter blades 18, 19 coact to cut off the wires 2 again. The wires 2 are cut off or processed in this manner by repeating the alternate operation of the rollers 14, 15 and the cutter blades 18, 19 (FIG. 11).

With the present invention, as described above, the wires embedded deeply in the compressed wastepaper block are partly exposed by bending the compressed wastepaper block arcuately so that the exposed wires can easily be clamped. At the same time, the wires on the convex side of the bent compressed wastepaper block are tensioned so that the tensioned wires can reliably be cut off. The severed wires are smoothly delivered out by the feeding means, and then cut off to predetermined dimensions by the cutting means. The above steps of operation are automatically successively effected according to a predetermined schedule.

While the wire processing apparatus of the present invention is shown and described as being used for processing or cutting off wires fastening a compressed wastepaper block, it may also be used for processing or cutting off wires fastening a compressed pulp block. Therefore, the scope of the present invention should be interpreted as including the processing of wires fastening such a compressed pulp block.

According to the present invention, therefore, when cutting off the wires, the compressed wastepaper block is not cut off, and hence the amount of produced paper dust is minimized and the working environment is not impaired. The wires on the convex side of the compressed wastepaper block can reliably and easily be cut off by the cutter because they are tensioned at the time they are severed. Therefore, undesirable wire cutting failures are prevented.

Since the severed wires remain gripped by the presser/wire clamp, they can smoothly be delivered out by the feeding means for easy subsequent processing of the wires.

Although certain preferred embodiments have been shown and described, it should be understood that many changes and modifications may be made therein without departing from the scope of the appended claims.

What is claimed is:

1. An apparatus for processing a plurality of wires fastening a compressed block of paper material, comprising:

means for bending the compressed block on a working table substantially arcuately to form opposite concave and convex sides on the block, the concave side exposing a first portion of each wire, such that the wire is tensioned due to the bending of the block;

means for gripping the first portion of each wire which is exposed on the concave side;

means for cutting a second portion of each wire which is disposed on the convex side; wherein the gripping means moves the wires to a severing means, means for feeding the wires cut by said cutting means; and the severing means for severing the wires fed by said feeding means.

2. An apparatus according to claim 1, wherein said bending means comprises a presser/wire clamp disposed on a first side of said working table for pressing the compressed block, and a bending guide plate for guiding the compressed block, said bending guide plate being disposed on a second, opposite side of the working table in confronting relation to said presser/wire clamp.

3. An apparatus according to claim 1, wherein said cutting means comprises a cutter movable toward and away from the compressed block by a hydraulic cylinder.

4. An apparatus according to claim 1, wherein said severing means comprises a fixed cutter blade and a movable cutter blade movable into coaction with said fixed cutter blade by a hydraulic cylinder.

5. An apparatus for processing a wire fastening a compressed block of paper material, comprising:

means for bending the compressed block on a working table substantially arcuately to form opposite concave and convex sides on the block, the concave side exposing a first portion of the wire;

means for gripping the first portion of the wire which is exposed on the concave side;

means for cutting a portion of the wire which is disposed on the convex side;

means for feeding the wire cut by said cutting means; and means for severing the wire fed by said feeding means, wherein said gripping means includes a rack disposed in said bending mean and a pair of fingers movable by said rack through a pinion and a gear coupled respectively to said fingers, for gripping and releasing the wire.

6. An apparatus for processing a wire fastening a compressed block of paper material, comprising:

means for bending the compressed block on a working table substantially arcuately to form opposite concave and convex sides on the block, the concave side exposing a first portion of the wire;

means for gripping the first portion of the wire which is exposed on the concave side;

means for cutting a second portion of the wire which is disposed on the convex side;

means for feeding the wire cut by said cutting means; and means for severing the wire fed by said feeding means, wherein said feeding means includes a fixed feed roller and a movable feed roller movable into action with said fixed feed roller.

* * * * *